US005860590A

United States Patent [19]

Blomfield et al.

[11] Patent Number: 5,860,590

[45] Date of Patent: Jan. 19, 1999

[54] STACKABLE CONTAINER OF PAPERBOARD

[75] Inventors: Gregory Thomas Blomfield; Robert William Coe, both of Auckland; Trevor Grant Burgess, Hastings, all of New Zealand

[73] Assignee: Carter Holt Harvey Limited, Manukau City, New Zealand

[21] Appl. No.: 930,769

[22] PCT Filed: Mar. 22, 1996

[86] PCT No.: PCT/NZ96/00023

§ 371 Date: Dec. 29, 1997

§ 102(e) Date: Dec. 29, 1997

[87] PCT Pub. No.: WO96/32329

PCT Pub. Date: Oct. 17, 1996

[30] Foreign Application Priority Data

Apr. 11, 1995 [NZ] New Zealand ..... 270912

[51] Int. Cl.[6] ..... B65D 5/00

[52] U.S. Cl. ..... 229/165; 229/916; 229/918; 229/120; 229/191

[58] Field of Search ..... 206/509, 501; 229/916, 165, 915, 918, 919, 119, 120, 174, 191, 198.2

[56] References Cited

U.S. PATENT DOCUMENTS

| | | | |
|---|---|---|---|
| 2,295,141 | 9/1942 | Van Wingen | 229/191 X |
| 2,934,250 | 4/1960 | Stotz | 229/191 X |
| 3,114,493 | 12/1963 | Dunkin | 229/117.17 X |
| 4,134,533 | 1/1979 | Heavner | 229/915 X |
| 4,770,339 | 9/1988 | Weimer | 229/174 X |
| 4,923,113 | 5/1990 | Guijarro | 229/125 |
| 5,294,044 | 3/1994 | Clark | 229/191 |
| 5,429,296 | 7/1995 | Southwell et al. | 229/919 X |
| 5,452,848 | 9/1995 | Gimeno | 229/191 |
| 5,535,941 | 7/1996 | Garza | 229/915 X |
| 5,649,663 | 7/1997 | Pestow, Jr. | 229/915 X |

FOREIGN PATENT DOCUMENTS

| | | |
|---|---|---|
| 61361/90 | 3/1991 | Australia . |
| 13040/92 | 11/1992 | Australia . |
| 0326451 | 8/1989 | European Pat. Off. . |
| 2306888 | 11/1976 | France . |
| 2615822 | 12/1988 | France . |
| 2682936 | 4/1993 | France . |
| 4017416 | 12/1990 | Germany . |
| 4102166 | 7/1992 | Germany . |
| 25100 | 3/1994 | New Zealand . |
| 25605 | 3/1994 | New Zealand . |
| 25101 | 6/1994 | New Zealand . |
| 237169 | 7/1996 | New Zealand . |
| 2086352 | 5/1982 | United Kingdom . |
| 2173480 | 10/1986 | United Kingdom . |
| 2188036 | 9/1987 | United Kingdom . |

*Primary Examiner*—Gary E. Elkins
*Assistant Examiner*—Tri M. Mai
*Attorney, Agent, or Firm*—Jacobson, Price, Holman & Stern, PLLC

[57] ABSTRACT

A container formed from a blank to define indexing longer walls having an inward incline but a double thickness provided by a foldline at the tops thereof so that the indexing projections are receivable within corresponding openings in the base of a corresponding container. Each part of the indexing walls has an extension such that at each end thereof one extension attaches to the outside of an end wall while the other attaches to the inside of an end wall with preferably that attaching to the inside of an end wall through a pair of parallel vertical folds providing a support at least in part for the weight of a stacked container.

17 Claims, 3 Drawing Sheets

STACKABLE CONTAINER OF PAPERBOARD

TECHNICAL FIELD

The present invention relates to improvements in and/or relating to (containers) cartons, blanks therefor, related packs and methods of use.

The present invention relations to a pack formed from a paperboard (preferably a paperboard which is a laminate involving a fluted paperboard medium) which provides a stackable container where a top of one is indexable reproducibly into the base of another.

BACKGROUND ART

The present invention is an evolution of an indexing pack of a kind as disclosed in our New Zealand Patent Specification No. 237169 (U.S. Pat. No. 5,361,976) and Registered Design Nos. 25100, 25101, 25605 and 25604. The full content thereof is hereby here included.

DISCLOSURE OF INVENTION

The present invention however is directed to preferably at least a substantially lidless form capable of providing a stable stack of like containers with their loads where the weight is capable of being taken through the wall structures of such containers without any substantial passage of stress into the load of the containers themselves.

A pack form in accordance with the present invention is useful for fruits such as apples etc. It is therefore an object of the present invention to provide such containers, blanks, packs etc. or to at least to provide the public with a useful choice.

In a first aspect the present invention consists in a container formed from a blank, said container having a rectangular base, a flap sequence of two flaps (hereafter the "indexing wall flaps") from each of the longer sides of said base, a first flap being connected to the base by a fold line, and the second flap being connected to the first flap by a fold line preferably through bridge like regions), and wherein each indexing wall flap of each flap sequence has an extension beyond a fold-line or fold-lines (preferably one only) substantially normal to that of a said indexing wall first flap with the base and, in turn, that between two flaps (first and second) of the indexing wall flaps, and a flap from each of the shorter sides of said base (hereinafter the "non indexing wall flaps"), and wherein said base includes inwardly of the fold line thereof with its proximate indexing wall first flap a plurality of openings each to receive a projection formed by a folding (preferably of each bridge like region) of a like container at the fold line between the two indexing wall flaps of a like container, and wherein said container is erected to a walled form with the indexing walls presenting a plurality of upwardly directed projections (preferably formed from said bridge like regions) of the blank and being indexable in through the openings of the base of a like erected container, said indexing walls being inclined inwardly slightly with the extensions of said indexing wall flaps adhesively attached one extension on either side of the closer up folded non indexing wall flap.

In some less preferred forms "rectangular" may approach or be "square".

Any mechanical equivalent to a bridge form projection can if desired be employed (eg; pop-ups from a fold line) but these will offer less certainty in indexing. Such a form has reduced adhesion, usefulness and overall strength.

Preferably said non indexing wall flaps are strictly vertical from the base.

Preferably said blank is of a laminate which includes a flute providing medium and the flute direction is such that the flutes extend substantially vertically in said indexing walls.

Preferably the extensions of each of the second flap of a non indexing wall flap sequence folds inwardly and is attached inwardly of a non indexing wall flap, and provides with part of the flap thereof (preferably between substantially parallel fold lines) a gusset feature at the corner.

Preferably a handle opening is provided through each of the two flaps of a flap sequence of each indexing wall.

Preferably each non indexing wall is provided with a recess from the upper extremity thereof to facilitate air flow through.

Preferably the angling in of the indexing walls is such as to provide a top to top distance between the indexing walls that is of the order of about 8 mm less than that between the fold lines of the first flap of the flap sequences from said base. For example preferably an angle of the order of 2° is provided where the spacing between the fold lines from the base of said indexing wall flap sequences is of the order of 396 mm.

In a further aspect the present invention consists in a blank suitable for construction and/or erection to provide a container as previously set forth.

In still a further aspect the present invention consists in as a stack a plurality of containers as previously set forth.

In yet a further aspect the present invention consists in adjacent stacks as previously set forth where the inwardly inclined indexing walls are adjacent one to another thereby providing a wedge shape gap which facilitates for cooling, and/or for other purposes, the movement of air.

In yet a further aspect the present invention consists in the use of a container in accordance with the present invention.

BRIEF DESCRIPTION OF DRAWINGS

Preferred forms of the present invention will now be described with reference to the accompanying drawings in which.

Figure 1:
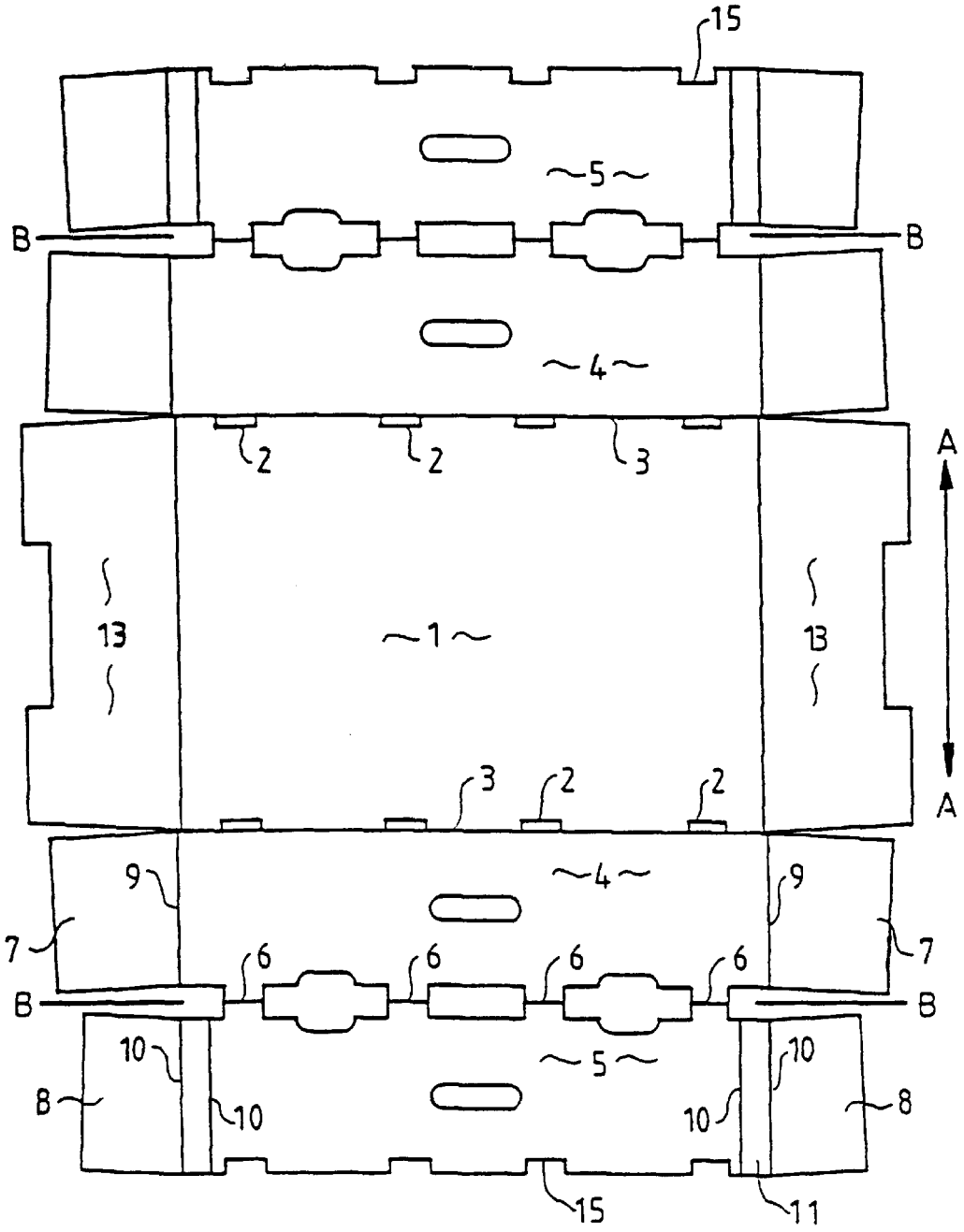
FIG. 1 is a view of a preferred blank in accordance with the present invention.

In the preferred form the carton is preferably made from a paperboard, preferably a flute cored sheet faced laminate with the flute direction being in the direction "AA" depicted on FIG. 1.

FIG. 1 shows the blank form of the present invention with the base 1 being provided with a plurality of openings 2 to the foldline 3 with the first flap 4 of each of the two indexing wall flap sequences of two flaps. The second flap 5 of each of the two flap sequences is connected by a foldline "BB" with the first flap 4 of the indexing wall flap index. Preferably the foldline is at a plurality of bridging regions 6 each of which is to provide upon folding of the second flap 5 inwardly of the container an upstanding projection 14 best seen in the FIGS. 3 and 4 each of which is adapted to be inserted into a complimentary opening of a like container to those labelled 2.

Each of the flaps 4 includes an extension flap 7 while each of the flaps 5 includes an extension 8. The extensions 7 are connected by a foldline 9 to the first flaps 4 while the extensions 8 are connected, preferably, by two foldlines 10 so as to provide a gusset form feature 11 best seen in FIG. 4. Where however the paired foldlines 10 are not provided a single foldline can instead be provided substantially aligned with the foldline 9. The foldlines of such extensions are angled as required relative to the base axes.

A feature of the present invention is the inward incline of the indexing walls 12 when the carton is erected.

The erecting arrangement is such that the flaps 13, which provide the non indexing walls when upturned, are each sandwiched by a flap 7 and 8 at each extremity thereof with those extensions 7 of the first flap 4 being affixed on the outside face of each non indexing wall flap 13 while those extensions 8 are to be affixed on the insides.

In the arrangement as depicted the structure is such that in the flute running direction the width of a preferred container is 396 mm from foldline 3 to foldline 3. The preferred angle for such a product where the indexing wall structures are to be of the order of 165 mm high (external wall measurement) is that the tops of the indexing lugs 14 are approximately 8 mm closer together than they would be if the indexing walls were vertical from the base. This angling in of approximately 2° from the vertical on each side allows a more easy index of each indexing lug 14 through its complementary opening 2 and into the accommodating recess region 15 of each of the second flaps 5.

Preferably that offset of about 8 mm is used for other base sizes ie; the angle adjusts accordingly.

Figure 2:
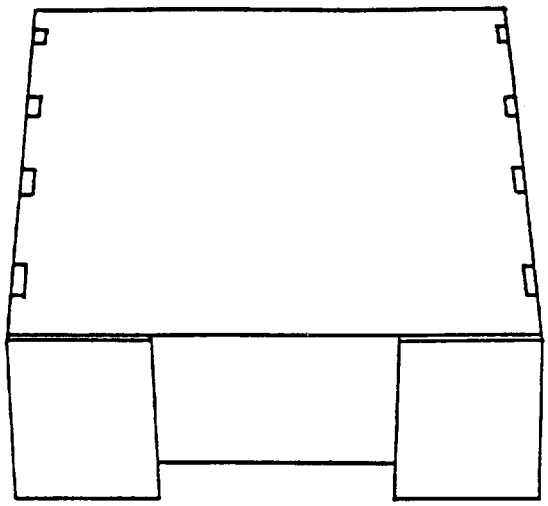
FIG. 2 is an erected container in accordance with the present invention when viewed from below showing in the preferred form of the present invention, adjacent each indexing wall, a plurality of indexing openings in the base.
Figure 4:
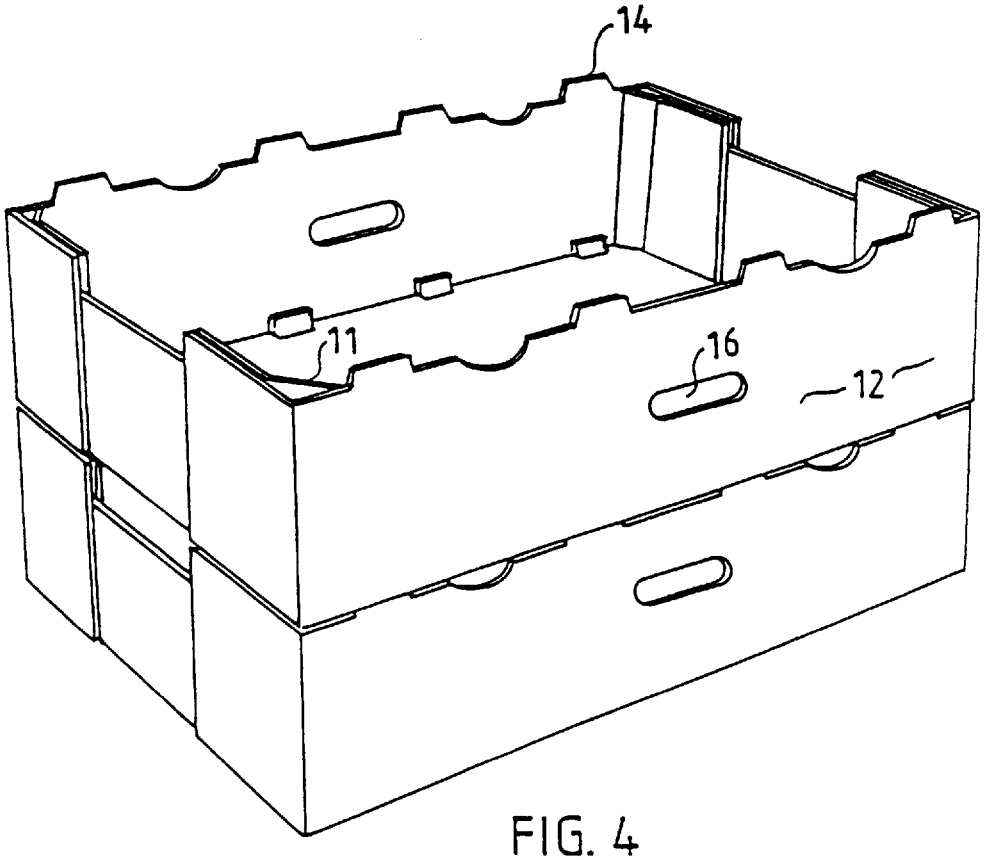
FIG. 4 shows the stack indexing characteristics of a pair of containers in accordance with the present invention which when a stack is brought into a condition adjacent a like stack (whether in the arrangement as shown in FIG. 3) or where indexing wall is again indexing wall (which doubles the size of the gap shown in FIG. 3) air circulation is possible about the stacks as well as through each container of the stacks owing to the various openings formed therein.
Figure 3:
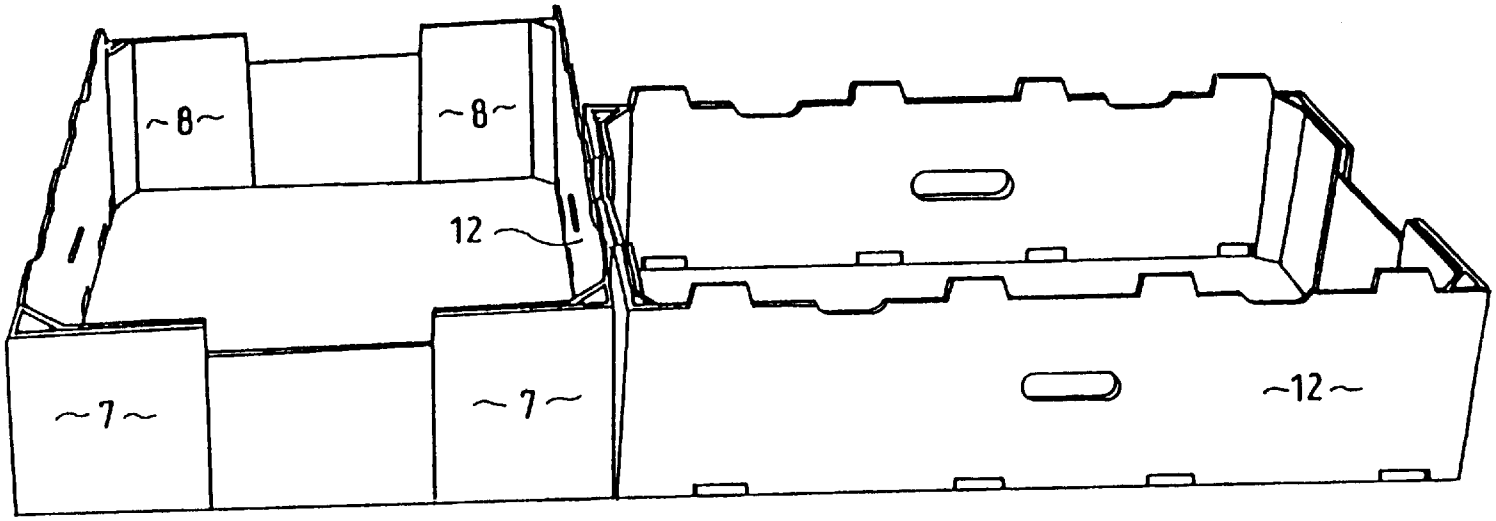
FIG. 3 is a view from above of two erected containers in accordance with the present invention showing how the indexing wall of the left container, when butted against the preferable non inclined non indexing wall of the other, there is still provided a gap suitable for assisting air movement between the containers of a stack.

In an erected carton with the flaps 7 and 8 adhesively affixed to the non indexing wall flaps 13 a structure as depicted in FIGS. 2 to 4 results having an advantage of strength owing to the construction, the stacking strength coming from the indexing of wall to wall using the male protuberances much in the same way as disclosed in the aforementioned New Zealand Patent Specification. In addition where a support structure 11 is provided in a corner there is additional strengthening owing to greater resistance to racking forces as well as more vertical structural support. Nevertheless even in the forms without the corner feature 11 a container of acceptable strength is provided which provides an advantage as far as the removal of field temperature from any crop to be stacked in the containers is concerned. This is because the various relief features and openings (including the handle feature 16) all as shown allows a throughput of air through a container above its fruit or other load and under the base of a stacked on top container while additional airflows are possible around the stack owing to the fact that the indexing walls are inclined slightly.

A preferred material from which such a container can be made is a dual arch (2×160 gm/m$^2$) semi chemical pulp paper corrugated board with outside lines of 290 gm/m$^2$ kraft.

Persons skilled in the art will appreciate the alternatives that a structure in the accordance with the present invention provides.

We claim:

1. A container formed from a blank, said container comprising:

a rectangular base having opposed longer sides and opposed shorter sides, a flap sequence of two indexing wall flaps extending from each of the longer sides of said rectangular base, a first indexing wall flap of each flap sequence being connected to the base by a fold line, and the second indexing wall flap of each flap sequence being connected to the first flap, and each indexing wall flap of each flap sequence having an extension flap beyond a fold-line extending substantially normal to said fold-line of said first indexing wall flap with the base, and a non-indexing wall flap extending from each of the shorter sides of said base, said base including a plurality of openings, and said container, when erected, each indexing wall flap sequence having been folded to define an upwardly directed, inwardly inclined indexing wall, and, in the erected form, above a transition between each sequence of the first indexing wall flaps and second indexing wall flaps there are defined a plurality of projections, each projection being indexable by one of said plurality of openings of the base of another erected container in a stacking configuration, and, when erected, in the corners of the erected containers, the extensions of each of the second indexing wall flaps fold inwardly to define a gusset configuration, and, when additional erected containers are stacked, each wall of the longer sides of the base is indexed into a superimposed base and each superimposed base, under load, is in part supported at said gusset configuration.

2. A container of claim 1, wherein said non indexing wall flaps extend substantially vertically from the base.

3. A container of claim 1, wherein said blank is a laminate including a flute providing medium having a flute direction such that the flutes extend substantially vertically in said indexing walls.

4. A container of claim 1, wherein each said gusset configuration is formed by substantially parallel fold lines.

5. A container of claim 4, wherein a handle opening is provided through each of the two indexing wall flaps of a flap sequence of each indexing wall.

6. A container of claim 5, wherein each non indexing wall is provided with a recess extending from an upper extremity thereof to facilitate air flow therethrough.

7. A container of claim 6, wherein the inwardly inclined indexing walls include a top to top separation distance between the indexing walls of 8 mm less than a separation distance between the fold lines of said first indexing wall flap of the flap sequences from said base.

8. A container of claim 7, wherein an angle of 2° is provided when a spacing between the fold lines from the base of said indexing wall flap sequences is 396 mm.

9. As a stack a plurality of containers as claimed in claim 1.

10. Adjacent stacks each of a kind as claimed in claim 9 where the inwardly inclined indexing walls are adjacent one to another thereby providing a wedge shape gap which facilitates the movement of air.

11. A container of claim 1, wherein each indexing wall flap is adhesively attached to an adjacent non-indexing wall flap such that each non-indexing wall flap is sandwiched between two of said extensions.

12. A container of claim 1, wherein the projections defined by said transition between said indexing wall flaps is through bridge regions between said indexing wall flaps and which constitute part of each said indexing wall flap.

13. A container of claim 1, wherein the projections are formed in double thickness by a portion of each of the two indexing wall flaps.

14. A container of 1, wherein the second flap of each flap sequence being connected to the first flap of each flap sequence by a fold line.

15. A container of claim 12, wherein each extension extends beyond the fold-line extending substantially normal to the fold line of the first indexing wall flap with the base and also extends normal to a fold line between the two indexing wall flaps.

16. A container of claim 1, wherein the extensions of each of the second indexing wall flaps are partially adhesively attached to a non-indexing wall flap to define the gusset configuration.

17. A container formed from a blank, said container comprising:

a rectangular base having opposed longer sides and opposed shorter sides, a flap sequence of two indexing wall flaps extending from each of the longer sides of said rectangular base, a first indexing wall flap of each flap sequence being connected to the base by a fold line, and the second indexing wall flap of each flap sequence being connected to the first flap, and each indexing wall flap of each flap sequence having an extension flap beyond a fold-line extending substantially normal to said fold-line of said first indexing wall flap with the base, and a non-indexing wall flap extending from each of the shorter sides of said base, said base including a plurality of openings, and, when erected, each indexing wall flap extension being at least partially adhesively attached to an adjacent non indexing wall flap such that each non indexing two wall flap is sandwiched between two wall flap extensions, and said container, when erected, each indexing wall flap sequence having been folded to define an upwardly directed, inwardly inclined indexing wall, and, in the erected form, above a transition between each sequence of the first indexing wall flaps and second indexing wall flaps there are defined a plurality of projections, each projection being indexable by one of said plurality of openings of the base of another erected container in a stacking configuration, and, when erected, in the corners of the erected containers, the extensions of each of the second indexing wall flaps fold inwardly to define a gusset configuration, and, when additional erected containers are stacked, each wall of the longer sides of the base is indexed into a superimposed base and each superimposed base, under load, is in part supported at said gusset configuration.

* * * * *